US005162007A

United States Patent [19]

Leslie

[11] Patent Number: 5,162,007

[45] Date of Patent: Nov. 10, 1992

[54] AIR-BUBBLE CUSHION, MATTRESS AND WATER FLOAT ITEMS

[76] Inventor: Phillip Leslie, 5340 Calvin Ave., Tarzana, Calif. 91356

[21] Appl. No.: 599,682

[22] Filed: Oct. 18, 1990

[51] Int. Cl.[5] ..... B63C 9/08

[52] U.S. Cl. ..... 441/129; 441/136

[58] Field of Search ..... 441/80, 35, 88, 125, 441/129-132, 136; 5/449; 405/21, 24, 72

[56] References Cited

U.S. PATENT DOCUMENTS 2,950,489 8/1960 Pattison ..... 441/113
3,545,017 12/1970 Cohn ..... 441/112
3,852,965 12/1974 Rudd ..... 405/72
4,287,250 9/1981 Rudy ..... 5/449 X
4,490,071 12/1984 Morrisroe ..... 405/21 X

*Primary Examiner*—Edwin L. Swinehart
*Attorney, Agent, or Firm*—Philip D. Junkins

[57] ABSTRACT

Cushions, mattresses and water float articles for body comfort, water safety and recreational use. The articles of the present invention include a light weight core structure fabricated of at least two stacked layers of two-ply laminated sheet plastic material encapsulating between the plys of each layer a multiplicity of uniformly arranged, separated and sealed air bubbles. The core structure is encased and sealed in a water impermeable cover of flexible sheet plastic material with the cover material maintaining the shape of the article.

7 Claims, 1 Drawing Sheet

AIR-BUBBLE CUSHION, MATTRESS AND WATER FLOAT ITEMS

BACKGROUND OF THE INVENTION

The present invention relates to cushions, mattresses and water float items for body comfort and for recreational pleasure. More particularly, the invention relates to a wide variety of dry land body comfort and recreational items which provide cushioning support to the user's body and body parts and to a wide variety of water environment items which provide user safety and pleasure as water float objects and devices.

Over recent years there has been proposed, manufactured and marketed a multiplicity of cushion or pillow and mattress items for out-of-water body and body part support and comfort in both sitting and prone body positions. These items have included home use and medically prescribed cushions and mattresses formed with internal cushioning springs, sponge rubber materials, and compressible foam plastic materials or formed so as to permit water and air inflation. They have also included camping cushions and mattresses formed by air inflation. Further, there has been produced a great number of water environment body support items and floatation products, safety devices, and floatable toys. Again, these items have included: cushions, lounges and mattress floats formed with an internal core of light sponge rubber and foam plastic materials or formed so as to be air inflated; floatation safety rescue rings, life preservers and jackets, and life rafts formed of internally disposed floatable material and or formed by air inflation; and floatable entertainment and pleasure devices including floating food and drink tables, game boards, and children's support toys for swimming pool use.

The prior art cushion, mattress and water floatation items, of the type described above, are satisfactory from the standpoint of functionality. Water and air inflation items of the above types are subject to deflation if punctured. Further, cushion, mattress and water floatation items of the types fabricated of light-weight, compressible sponge rubber or foam plastic materials are rather expensive.

It is a principal object of the present invention to provide improved air-buoyed water floatation lounges and floatable entertainment and pleasure items for swimming pool usage which are inexpensive to fabricate and which are not subject to sudden deflation by loss of air.

It is another object of the present invention to provide improved light weight air cushions, pillows and mattresses which provide body and body part support and comfort in both sitting and prone body positions and which are not subject to sudden deflation by loss of air.

It is yet another object of the present invention to provide water safety devices, including life preserver rings, life jackets and life rafts, which are of light weight construction, are air-buoyed and are not subject to sudden deflation by loss of air.

These and other objects and advantages of the present invention will become apparent from the following summary of the invention and detailed description thereof taken in conjunction with the accompanying drawing figures.

SUMMARY OF THE INVENTION

The present invention relates to light weight articles of manufacture including: pillows, cushions and mattresses for home, recreational vehicle, boat and camping use; recreational swimming pool items such as floating mattresses, lounges, rafts, drink and food floats, game board floats, and floating toys; and water safety equipment such as life saving rings, life jackets and life rafts. The articles all utilize in their construction multiple layers of air-bubble sheet plastic material encased in a flexible outer sealed containment cover of sheet plastic material.

The layers of sealed air-bubble sheet plastic material may be readily sculptured to provide the desired ultimate form of each article since every air bubble of each sheet of the material is isolated from the other bubbles of the sheet. For each article, the stack of air-bubble sheets (in either sculptured or unsculptured configuration) is encased within conforming sheet plastic cover sections which are sealed at their mating edges. Thus, in accordance with the invention, the finished article comprises an air shaped comfort, recreational or safety item which is not subject to rapid or full deflation by punctures because of the isolated nature of the individually sealed air bubbles of the sheets forming the article.

BRIEF DESCRIPTION OF THE DRAWING FIGURES

DESCRIPTION OF THE PREFERRED EMBODIMENTS OF THE INVENTION

Figure 1:
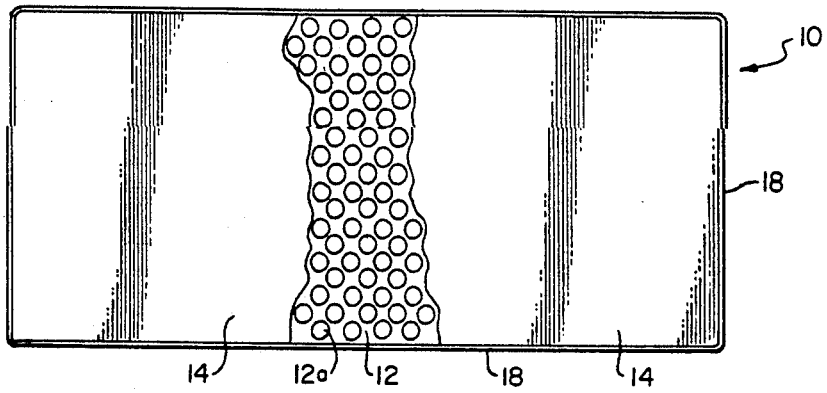
FIG. 1 is a top plan view of a home, recreational vehicle, boat, or camping use mattress or pillow or a water floatation mattress or life raft in accordance with the present invention with the upper surface cover material partially cut away to show the internal air-bubble construction of the mattress.
Figure 2:
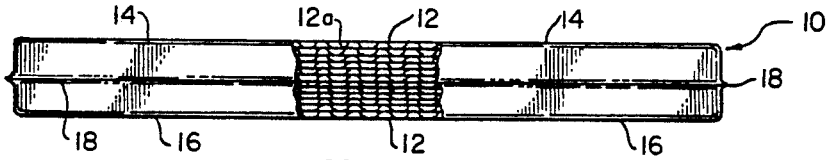
FIG. 2 is a front elevation view of the mattress, pillow or life raft of FIG. 1 with the side surface of the cover material partially cut away to further show the layered construction of the mattress.

Referring now to the drawings, FIG. 1 is a top plan view of a home, recreational vehicle, boat or camping type of mattress or pillow or a water floatation mattress 10 in accordance with the present invention. FIG. 2 is a front elevation view of the mattress or pillow of FIG. 1. The mattress 10 is comprised of a stack of layers 12 of air-bubble sheet material of known structure and the stack of layers of air-bubble sheet material is sealed within a sheet plastic cover which, as shown, is comprised of an upper cover portion 14 and a lower cover portion 16 conformed to the stack of air-bubble sheets and heat sealed together at their mating edges 18.

In FIG. 1 the sheet plastic cover of the mattress or pillow 10, comprised of upper and lower cover portions 14 and 16, is cut away to expose in plan view the circular, uniformly situated, individually sealed air bubbles 12*a* formed in known manner between two thin sheets of plastic material, such as polyethylene. The air bubbles of the typical air-bubble sheet material range in size (diameter) from about 3/16 inches to about 1 inch. For a mattress of the type shown in FIGS. 1 and 2 (6–7 foot long and 2.5–3.0 foot wide), it is preferred to use from between 10 to 15 layers of air-bubble sheet material having bubbles of about 1 inch in diameter. The 3/16 inch bubbles may have a height dimension from the lower flat sheet of the air-bubble material of about 1/16 inch whereas air-bubble material having 1 inch diameter bubbles may have a bubble height dimension of ¼ inch or more. The cover material for the mattress is preferably impermeable sheet vinyl material having a thickness of about 10 to about 15 mils. Thus, a very light weight mattress constructed of 10 to 15 layers of air-bubble sheet material, in accordance with the invention, may have an overall thickness of from about 2 and ½ inches to about 3 and ½ inches. The resulting mattress is flexible and if punctured by a sharp object does not deflate because only several of the thousands of air bubbles are ruptured.

Figure 3:
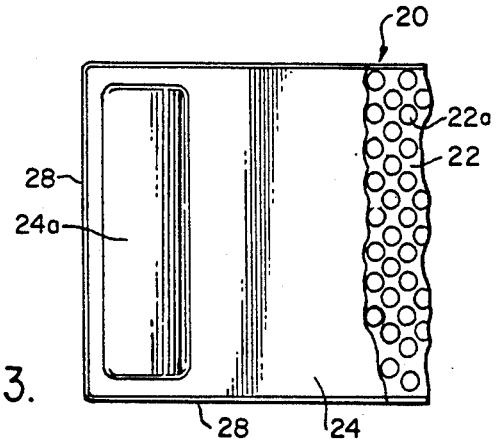
FIG. 3 is a partial top plan view of an out-of-water or water floatation lounge-type mattress, including an integral pillow portion, in accordance with the invention with the upper surface cover material partially cut away to show the internal construction of the lounge-type mattress.

Referring now to FIG. 3 there is shown, in a partial top plan view, an out-of-water or water floatation lounge-type mattress 20, including an integral pillow portion in accordance with the invention. As shown, the upper surface cover material is partially cut away to provide an internal view of a layer 22 of the internal air-bubble sheet material from which the mattress is constructed. This figure again illustrates the circular, uniformly situated, individually sealed air bubbles 22*a* of the air-bubble sheet material.

Figure 4:
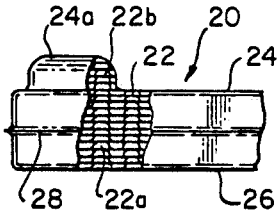
FIG. 4 is a partial front elevation view of the lounge-type mattress of FIG. 3 with the side surface cover material partially cut away to show the internal layered construction of the lounge-type mattress.

FIG. 4 is a partial front elevation view of the lounge-type mattress 20 of FIG. 3 with the side surface cover material (upper cover portion 24 and lower cover portion 26 heat sealed at their mating peripheral edges 28) partially cut away to illustrate the internal layered construction of the mattress via the air-bubble sheet layers 22. The integral pillow portion of the mattress is formed of air-bubble sheet layers 22*b* which are sculptured or cut so that ascending layers are of progressively smaller size to yield the pillow form. The upper cover portion 24, of water impermeable plastic sheet material, is conformed in its pillow covering area 24*a* to smoothly cover the air-bubble layers 22*b* forming the integral pillow portion of the mattress. The light weight mattress 20 of FIGS. 3 and 4 can be used as a home, recreational vehicle, boat or camping mattress or as a floatable swimming pool lounge-type mattress.

Figure 5:
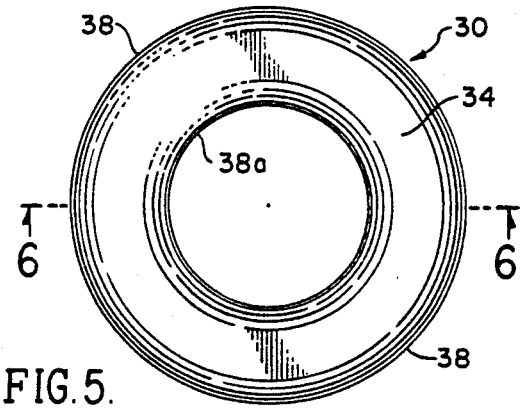
FIG. 5 is a top plan view of a ring-type water safety device in accordance with the present invention.
Figure 6:
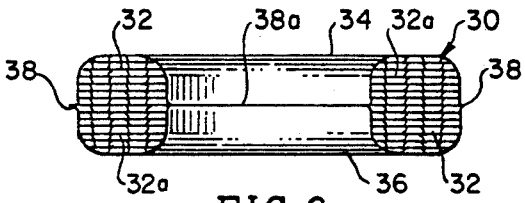
FIG. 6 is a sectional view of the ring-type water safety device of FIG. 5 taken along line 6—6 of such figure.

Referring to FIG. 5 there is illustrated, in a top plan view, a ring-type water safety floatation device 30 in accordance with the present invention. FIG. 6 is a sectional view of the floatation device 30 of FIG. 5 taken along line 6—6 of such figure. The ring-type device 30 is formed by stacked layers 32 of air-bubble sheet material (with air bubbles 32*a*) as described heretofore. Again, the ring layers 32 of the air-bubble material are cut or sculptured to form the safety ring or life preserver shaped item. The cover for the floatation device 30 is formed of water impermeable upper and lower portions 34 and 36, respectively, of plastic sheet material which are heat sealed or welded at the outer peripheral mating edges 38 and inner peripheral mating edges 38*a* of such cover portions.

Figure 7:
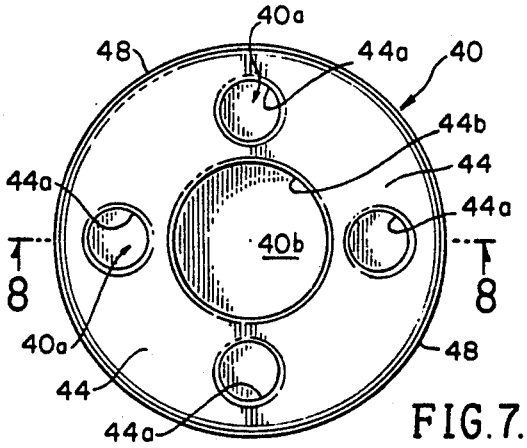
FIG. 7 is a top plan view of a floatable beverage or food tray for swimming pool use in accordance with the invention.
Figure 8:
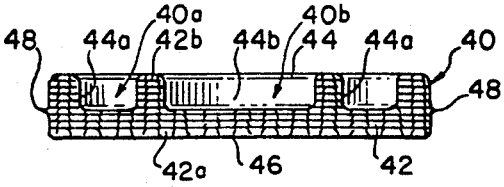
FIG. 8 is a sectional view of the floatable beverage or food tray of FIG. 7 taken along line 8—8 of such figure.

FIG. 7 is a top plan view of a floatable beverage or food tray 40 for swimming pool use in accordance with the invention. FIG. 8 is a sectional view of the floatable beverage or food tray of FIG. 7 taken along line 8—8 of such figure. The tray 40 is formed by stacking layers 42 of air-bubble sheet material (with air bubbles 42*a*) as the base of the tray and thereafter stacking sculptured or pre-cut rings 42*b* of such material (above the base layers) to form various outer cup-holding depressions 40*a* and an inner bowl-type depression 40*b* in the tray structure. The cover for floatable tray 40 is formed of upper and lower water impermeable portions 44 and 46, respectively, of plastic sheet material which are heat sealed or welded together at their outer peripheral mating edges 48. The upper cover portion 44 is conformed to smoothly encase the upwardly extending layers of pre-cut rings 42*b* of the air-bubble sheet material and to extend downwardly in its portions 44*a* to cover the outer cup-holding depressions 40*a* and in its portion 44*b* to cover the central bowl-type depression 40*b*.

The invention described above is susceptible to variation, modifications and changes in structure and materials of fabrication, all of which are within the skill of the prior art. It should be understood that all such variations, modifications and changes are within the spirit and scope of the invention and the appended claims. Similarly, it is to be understood that it is intended to cover all changes, modifications and variations of the preferred embodiments of the invention herein described for the purpose of illustration which do not constitute departures from the spirit and scope of the invention.

What I claim is:

1. In a water float article for body comfort and floatation support, water safety and recreational use, the improvement comprising:

a) a light weight core structure of three dimensional shape for said article fabricated of an arrangement of two or more separate and freely stacked, individually sized and configured, layers of two-ply laminated sheet plastic material encapsulating between the plys of each layer a multiplicity of uniformly arranged and separated air bubbles, the plys of said layers being sealed together in the areas between said air bubbles; and b) an outer, water impermeable cover of flexible sheet plastic material encasing and conforming to the core structure of said article and maintaining the shape thereof, said cover being comprised of two cover sections having mating edges and said cover sections being heat sealed together along said mating edges.

2. The improved water float article as claimed in claim 1 wherein said outer, water impermeable cover material encasing the core structure of said article is a vinyl plastic sheet material.

3. The improved water float article as claimed in claim 1 wherein the sheet plastic plys of said two-ply laminated material comprising each of the stacked layers of said core structure are formed of polyethylene plastic sheet material.

4. The improved water float article as claimed in claim 1 wherein the three dimensional shape of the core structure of said article is configured as a life preserver ring and said article comprises a water safety device.

5. The improved water float article as claimed in claim 1 wherein the three dimensional shape of the core structure of said article is configured as a life raft and said article comprises a water safety device.

6. The improved water float article as claimed in claim 1 wherein the three dimensional shape of the core structure of said article is configured as a body support mattress and said article comprises an entertainment and pleasure item for swimming pool usage.

7. The improved water float article as claimed in claim 1 wherein the three dimensional shape of the core structure of said article is configured as a body support lounge and said article comprises an entertainment and pleasure item for swimming pool usage.

* * * * *